United States Patent [19]

Smith

[11] Patent Number: 4,490,925

[45] Date of Patent: Jan. 1, 1985

[54] LOW PERMEABILITY SPIRAL FABRIC AND METHOD

[75] Inventor: Richard W. Smith, Greenville, S.C.

[73] Assignee: Wangner Systems Corporation, Greenville, S.C.

[21] Appl. No.: 502,255

[22] Filed: Jun. 8, 1983

[51] Int. Cl.[3] ..... F26B 13/08

[52] U.S. Cl. ..... 34/42; 34/116; 34/123; 34/243 R; 139/383 A; 474/260; 428/222

[58] Field of Search ..... 34/116, 123, 243 R; 139/383 A, 408, 411, 41 B; 428/259, 296, 222; 474/260, 264; 198/848, 851

[56] References Cited

U.S. PATENT DOCUMENTS

| | | | |
|---|---|---|---|
| 4,362,776 | 12/1982 | Lefferts et al. | 162/348 |
| 4,381,612 | 5/1983 | Shank | 34/123 |
| 4,392,902 | 7/1983 | Lefferts | 162/348 |
| 4,395,308 | 7/1983 | Dawes | 162/348 |

*Primary Examiner*—Larry I. Schwartz
*Attorney, Agent, or Firm*—Cort Flint

[57] ABSTRACT

A fluid permeable fabric is disclosed having particular advantages as a dryer fabric for papermaking is disclosed. The fabric includes a number of helix A extending cross-wise in the fabric and joined together along the length dimension by pintles 38. Crevice spaces 40 formed by intermeshing bend portions extending into the loop openings C are closed by a contoured filler strip B. The contoured filler strip occupies the loop openings and includes contoured edges 56 which penetrate and occupy a substantial portion of the crevice spaces. A fabric having a low permeability is thus provided. An enlarged heat radiating surface 52 facing the paper side 39 of the fabric increases the heat transfer occurring in the paper web W to expedite drying. Crevice space 40 and tapered edges 56 of the filler element provide a guiding function which facilitates filler insertion in the loop openings.

10 Claims, 7 Drawing Figures

LOW PERMEABILITY SPIRAL FABRIC AND METHOD

BACKGROUND OF THE INVENTION

In the typical papermaking machine, an aqueous suspension of fibers is transformed into a paper web as it is processed through the different sections of the machine. One section of the papermaking machine is the dryer section wherein a wet paper web is passed about and held in intimate heat transfer relation with upper and lower arrays of heated cylinders in order to remove water from the paper web. The dryer section normally includes an upper and lower array of heated cylinders arranged and spaced in staggered, parallel rows which have a solid imperforate surface for contacting the paper web. Several dryer sections may be found in a papermaking machine in series and stages. The paper web is passed generally to and fro between the arrays of dryer cylinders in a generally serpentine manner to insure that both sides of the paper web contact the cylinders. As the paper web passes over the dryer cylinders, it is held in intimate heat transfer contact therewith by a belt, commonly referred to as a dryer felt or dryer fabric which has been made endless by techniques which are well known in the field of papermaker's felts and clothing.

In the past, dryer fabrics generally have been substantially impervious structures of either woven or needle construction. However, the impervious structures, commonly known as dryer felts, do not ventilate sufficiently and thus serve to confine heated vapors in certain "pockets" created in the dryer section which cause uneven drying and affect paper quality. Thus, the trend is toward open weave fabrics which have been found to have desirable characteristics and many non-woven structures, such as needle felts, plastic perforated and helical belts, and the like have also been found suitable due to their increased permeability. Typically, these plastic, non-woven fabrics have yielded permeabilities as high as a thousand cubic feet per minute.

The non-woven plastic spiral fabric is desirable because it has fewer if any "knuckles," as in the case of woven fabric, and thus provides increased surface area for contacting and holding the paper. This paper supporting surface is also smoother and reduces markings on the paper. The plastic material and belt construction hold up extremely well under the stresses encountered when traveling endlessly at high speeds, typically 3000 fpm, about the belt rollers in contacting the paper web.

The high permeability of non-woven plastic belting provides increased pocket ventilation and hence drying, but can also lead to increased fluttering of the paper web sheet against the dryer fabric through a phenomena known as air "pumping." This is due to frictional drag on the air to move with the fabric. As the fabric contacts the cylinders or belt rolls, this air is forced through the fabric with the air movement away from the roll or dryer at a converging nip and toward the roll or dryer at a diverging nip. The effect of these forces is the net inflow of air into a dryer pocket, resulting in an outflow of air at the front and back sides of the machine. This turnover of air or air "pumping" is appreciable with highly permeable fabrics travelling at high speeds which can cause disruptive sheet flutter. If a highly permeable dryer fabric is operated at high speeds with a paper web of low strength, the paper web may break, be damaged, or be marked by fluttering against the fabric.

The problem of controlling the permeability of the basic spiral fabric, particularly in the low range of fabric permeability, is one to which much consideration is needed. A low fabric permeability is required for many papermaking and drying applications. For example, fine paper grades have a relatively thin sheet and do not contain as much water. They do not require a dryer fabric of high permeability nor is such desired since paper flutter of the light sheet is likely.

In U.S. Pat. No. 4,381,612, issued to the assignee herein, it has been proposed to close the mesh of a plastic dryer fabric to reduce paper flutter by utilizing a plastic or low-melt monofilament nylon stuffer element wherein the low-melt nylon may be heat treated to expand the plastic material in the helix loops and provide a low permeability characteristic for the fabric. While this provides good results in the low range of fabric permeability, it is desired yet to provide fabric permeability characteristics even lower for the finer grades of paper, and, if possible, to do so without the additional step of heat treatment of the filler element.

U.S. Pat. No. 4,362,776 discloses an attempt to avoid the problems attendant to inserting a filler strand or strands through the loop openings of a helical belt to lower its permeability by winding the helix strips about the filler material prior to joining the helix strips in the belt. The wavy material also more completely fills the helix strip.

Accordingly, an important object of the present invention is to provide a construction for a plastic non-woven dryer fabric for a papermaking machine and method by which a desired permeability characteristic may be built into the fabric.

Another important object of the present invention is to provide a non-woven dryer fabric and method having a low fabric permeability characteristic.

Yet another important object of the present invention is to provide a filler element and method for closing the mesh of a helical dryer fabric which may be more easily inserted in the fabric.

Still another important object of the present invention is to provide a non-woven helical dryer fabric having an open mesh which is closed by a contoured stuffer element which occupies a substantial area of the loop of the helix owing to its contour.

Yet another important object of the present invention is the method and construction for a helical mesh wherein the open loop of the helix material is filled with a contoured filler element to provide a low range of fabric permeability without an additional step of heat treating the filler.

SUMMARY OF THE INVENTION

According to the present invention, the above objectives are accomplished by providing a non-woven dryer fabric which includes a plurality of helixes formed from a polymeric material. The intermeshing loops of the helixes are joined together by pintle means and the loops of the helixes are closed by means of contoured filler elements of synthetic material which are inserted in the helix loops which can be utilized according to the method to produce a lower range of fabric permeabilities heretofore achieved and particularly suitable for fine grade papermaking. The filler elements are advantageously contoured to occupy crevice spaces created in each open loop of the helix by the intermeshing bend portion of adjoining helixes extending therein whereby maximum fabric closure and low permeability characteristics are provided.

In a preferred embodiment, the contoured filler element includes a widened base widened relative to an opposing base and tapering sides which taper outwardly from the opposing base toward the widened base terminating in contoured feathered edges. The stuffer elements are inserted into the loops of the spiral fabric. The feathered edges of the stuffer elements fit in the crevice spaces to more completely close off the mesh. By inserting the widened flat surface so that it is disposed on the paper side, an enlarged heat transfer surface is presented to the paper sheet. Better drying is achieved due to the larger mass and resulting radiant heat transferred from the flat widened surface to the yarn. The result is also provided of a guiding function of the contoured edges sliding in the crevice spaces to facilitate insertion of the stuffer element therein. The polymeric helixes and strands may be sealed together at the edges of the dryer fabric by passing a hot knife along the edge and applying cement to make an integral fabric structure.

BRIEF DESCRIPTION OF THE DRAWINGS

The construction designed to carry out the invention will be hereinafter described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

The invention relates to a method and construction of a dryer fabric for a dryer section of a papermaking machine. Since such papermaking machines are well known in the art, only so much of a papermaking machine as is necessary to an understanding of the invention will be illustrated.

Figure 4:
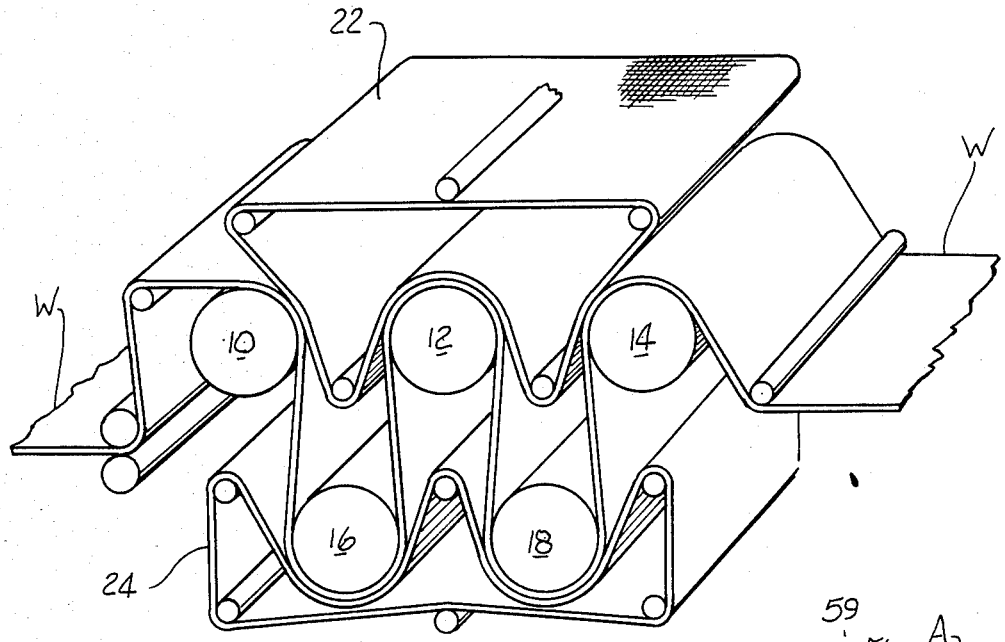
FIG. 4 is a perspective view illustrating a dryer section of a papermaking machine incorporating a non-woven dryer fabric constructed in accordance with the invention.

Accordingly, FIG. 4 is a simplified view of a portion of a dryer section of a papermaking machine wherein a continuous sheet-like web W of paper material is travelling from left to right. Several of such sections may be utilized in succession to dry the paper in stages. The dryer section includes an upper and lower array of horizontally disposed heated dryer cylinders which may be either of a perforated or imperforated construction. The upper array of heater cylinders includes cylinders 10, 12 and 14 with the lower array including cylinders 16 and 18. The continuous web of paper is received from the press section of the machine and is passed in a serpentine manner about the dryer cylinders as illustrated. The web first passes over and about upper cylinder 10, under cylinder 16, and then over cylinder 12 and so forth in a serpentine manner until it leaves the dryer section of the papermaking machine. Water and other fluids within the paper web are evaporated due to the paper contacting the cylinders.

The web W is guided through the dryer section and held in contact with the heated cylinders 10, 12, and 14 by means of an upper fluid permeable dryer fabric or belt 22, and a lower fluid permeable belt 24 guides and holds the paper web in contact with the lower cylinders 16 and 18. The dryer fabrics 22 and 24 are identical in their fabric construction as made in accordance with the present invention and will be more fully explained hereinafter. By contacting the paper web W, the dryer fabrics press and maintain the web in intimate heat transfer relationship with the dryer cylinders whereby the cylinders remove water or other fluids from the web.

Figure 1:
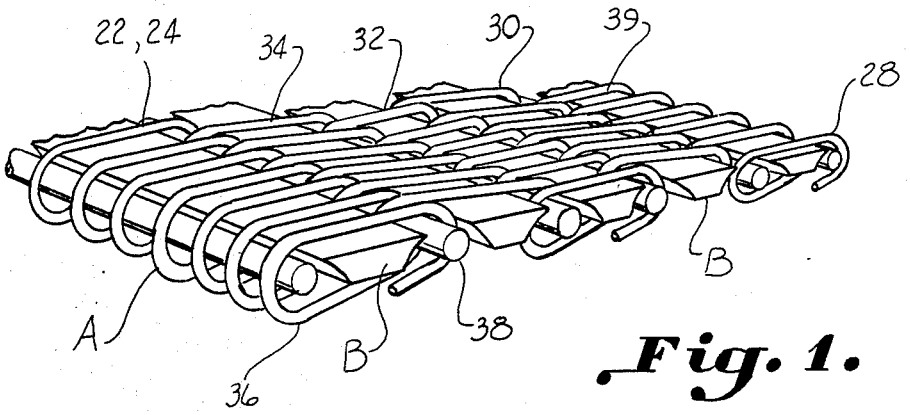
FIG. 1 is a perspective view illustrating a dryer fabric constructed according to the present invention as utilized in a drying section of a papermaking machine.

The drying process is outwardly from the heated cylinders through the paper web and through the dryer fabric. The "pockets" referred to in the background material are typically created in the enclosed areas bounded by the dryer fabric, paper web, and the heat cylinders, for example, area 25 bounded by fabric 22, cylinder 16, and the web W in FIG. 1. Accordingly, the dryer fabric must have a sufficient permeable construction in order to ventilate these pockets. But the permeability of the fabric should not be so high that the previously described disruptive sheet "flutter" between the paper web and the dryer fabric can occur whereby marking of the paper and derrogation of quality result.

In conventional woven dryer fabrics, dryer fabric construction is described in terms of yarns or elements extending in the machine direction (the direction in which the web travels) and yarns or elements extending in the cross-wise direction (across the width or transverse to the direction in which the web travels).

Figure 2:
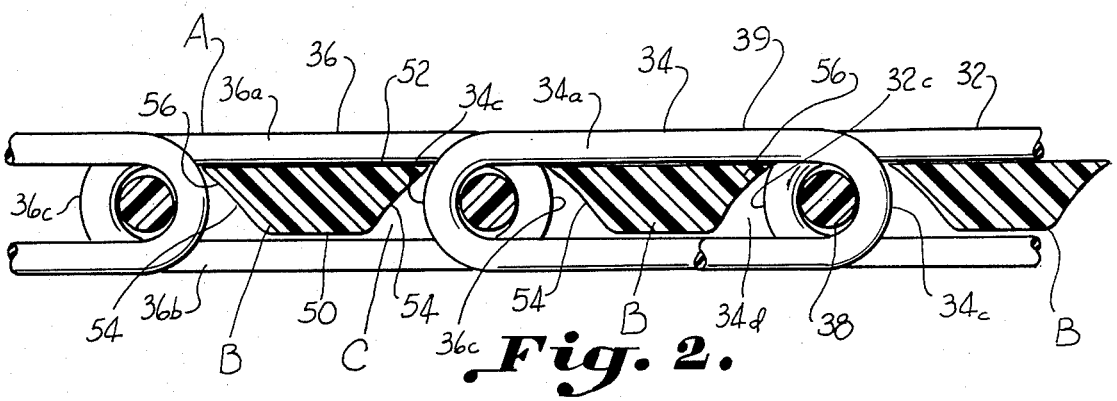
FIG. 2 is an enlarged elevation illustrating the closure affect of a contoured filler element for drying fabric according to the invention occupying the loop space and corner crevice spaces therein.

Referring now in more detail to the present invention, a dryer fabric 22, 24 is illustrated in FIG. 2 wherein the fabric consists of a series of helix means A in the form of helix strips such as 28, 30, 32, 34, and 36 which extend cross-wise in the fabric across the entire width thereof. The individual helix strips are constructed from a suitable polymeric material such as a monofilament polyester in order to have sufficient plasticity to withstand the stress of endless travel over the felt rollers under extreme temperatures and an acceptable shrink range. A suitable material is type WP809 polyester monofilament made by Shakespeare Co. having a 0.07 mm diameter.

Joint means for joining the adjacent helix lengths successively together in the machine direction is provided by pintles 38. The pintles are monofilament and extend through the intermeshing loops of adjacent helix strips joining same together successively to make a dryer fabric of a desired dimension in the machine direction which is ultimately made endless by joining the fabric end-to-end. Typically, such fabrics range from 8 to 340 inches cross-wise (width) and from 18 to 70 yards from end-to-end (circumference).

As illustrated, the helix means A, such as strip 34, includes loops or spirals which have an upper run 34*a* and lower run 34*b* which are generally parallel and present a flat and smooth paper contacting surface for the fabric. Curved bend portions 34*c* join the upper and lower runs 34*a* and 34*b* together at each end to complete each main helix loop 34 and define an otherwise open loop space 34*d*. Adjacent and adjoining helix strip 36 likewise includes top and bottom runs 36*a*, 36*b* and bends 36*c* on each end. Adjacent adjoining helix strip 32 includes top and bottom runs 32*a*, 32*b* and bend portions 32*c*.

An open mesh is ordinarily defined in the fabric face between opposing intermeshing bend portions, such as 36*c* and 32*c* and next adjacent top runs 34*a* of helix 34, through which air and/or vaporized water are transferred outwardly from the paper web. Top runs 32*a*, 34*a*, 36*a* face the paper and constitute the paper side 39 of the fabric. A corresponding open mesh is formed in the opposing face between the intermeshed bends and the bottom runs throughout the fabric.

Figure 7:
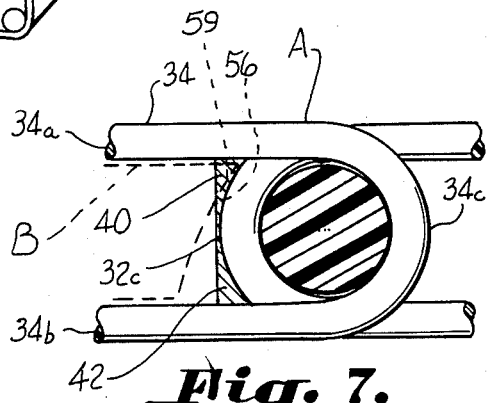
FIG. 7 is an enlarged side elevation of a pintle joint of a helical dryer fabric illustrating a loop corner crevice space and occupancy thereof by a contoured filler element according to the invention.

In the fabric construction, there are corner, wedge-shaped crevice spaces formed in the open loop spaces of the helicies by the upper runs of the loops and the intermeshing bend portions of adjoining helix strips extending therein. There are like bottom corner crevice spaces formed by the lower runs of each main loop and the intermeshing bend portion of adjoining helix strips extending into the loops. For example, there are corner crevice spaces 40 in loop 34 defined by the intersection of upper run 34*a* and intermeshing bend portions 32*c* and 36*c*, as can best be seen in FIG. 7. There are lower corner crevice spaces 42 in the lower corners of the loop space by the winding of lower run 34*b*.

These crevice spaces formed in the corners of the main loops create rather hidden sources of air flow which can add significantly to the total flow of air through the fabric. The permeability characteristic of the fabric is thus limited in this respect in the low range of fabric permeability.

According to the present invention, a contoured filler and closure element B is provided for filling the open space of each main loop in each helix strip in the fabric. The closure element is contoured to penetrate and substantially fill the crevice spaces of at least one of the upper or lower pair of opposing corners. That is, either the opposing spaces 40 or spaces 42. In preference, the upper corners on the paper side of the fabric containing spaces 40 are selected for reasons as will be explained more fully hereinafter.

Referring now in more detail to the drawings, an elongated contoured closure means B is illustrated which includes contoured edge means for substantially occupying the crevice spaces 40 in the right and left hand corners of the helix loops of each helix strip. The closure means is illustrated in the form of an elongated monofilament strip element which includes main body portions having a first base surface 50 and a second widened heat radiating surface 52 which is facing the paper side of the fabric. Tapering sides 54 taper as diverging from the base surface 50 to the widened surface 52. The tapering sides terminate in contoured feathered edges 56 to define the contoured edge means which penetrate and occupy the corner crevice spaces.

Contoured closure element B not only fills the open loop space more completely to provide a lower fabric permeability than can be achieved with a non-heat treated element, but certain other results not to be expected are provided. First, the contoured edges 56 on both sides of element B fit within the opposing corner crevice spaces and are guided thereby during fabric insertion. An upper portion 59 of tapering sides 54 rest on an upper part of bends such as at 32*c* and 36*c* in loop 34. Means for guiding the filler strip through the loops during insertion is thus provided by the crevice spaces acting as guide tracks during insertion through the helix strip across the entire fabric width. Secondly, with surface 52 facing the paper side of the fabric an enlarged heat radiating surface is provided for drying the paper contacting the paper side of the fabric. Heat from the heat cylinders is thus radiated onto the paper therebetween.

Figure 3:
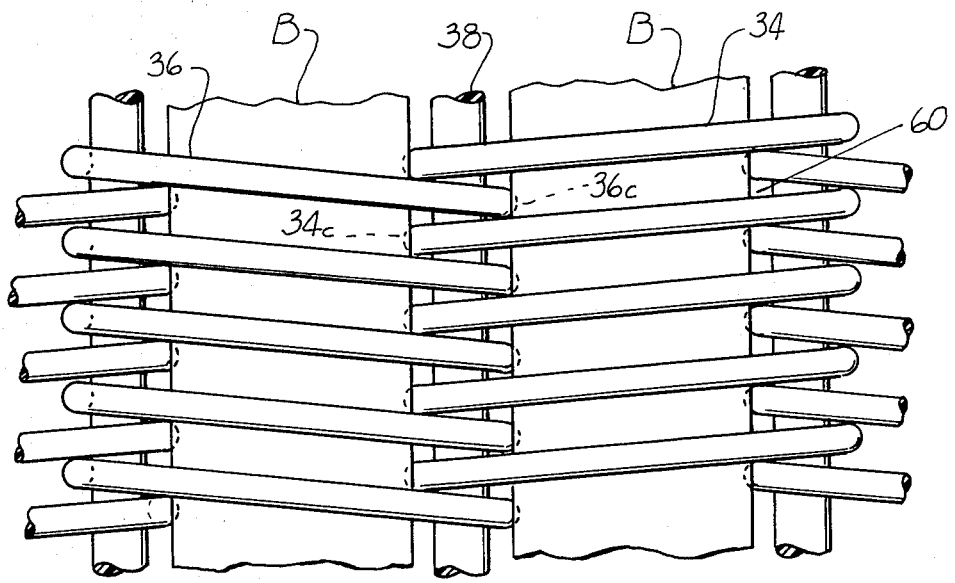
FIG. 3 is a top plan view of the dryer fabric constructed according to the present invention.
Figure 5:
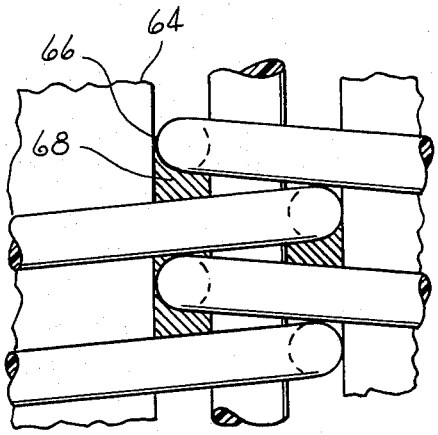
FIG. 5 is a top plan view of the pintle seam joint area of dryer fabric having a non-penetrating filler element.
Figure 6:
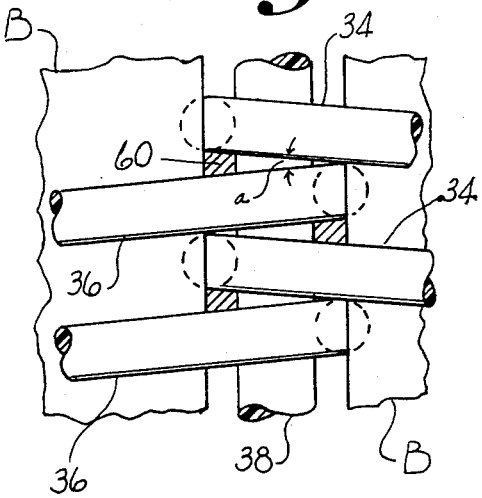
FIG. 6 is a top plan view of a pintle seam joint area of a helical dryer fabric incorporating a contoured filler element according to the invention penetrating the corner crevice spaces therein.

As can best be seen in FIGS. 2, 3, and 6, viewing the fabric from the paper side 39, it can be seen that the contoured edges 56 of filler element B extend well over the bends of adjoining loops of next adjacent helix strips to close off these otherwise undetected sources of air flow. The resultant size of the remaining open space 60 is substantially reduced over that of a stuffer element limited in its occupancy and penetration by the outermost portion of a loop bend such as element 64 limited at bend 66 creating a space 68, as can best be seen in FIG. 5.

Side crevice spaces 60 are created in part by the offsetting nature of adjoining helix strip spirals with respect to each other illustrated by angle, a. Penetration of contoured edges 56 closes this space.

The closure elements may be made of any suitable polymeric material which is compatible with the environment of the dryer section of the papermaking machine such as nylon, polyester, or polypropylene. A suitable material is type WP-803 polyester manufactured by the Shakespeare Co. of Columbia, S.C.

In practice, the polyester helical fabric is initially placed on a conventional stretcher frame in its finished endless construction and heated to a temperature of approximately 400 to 450 degrees fahrenheit at a pressure of 40 and 45 pounds per linear inch until the desired dimension of the fabric in the machine direction is obtained. The pressure (tension) and temperature are then reduced to a level at which the fabric will operate in a typical dryer section. By this process, the basic dryer fabric is heat set and thus thermally stable whereby its dimensions will remain unchanged within required tolerances during use under normal dryer operating pressure temperature, i.e., 250 to 350 degrees fahrenheit. Filler strip elements B are then inserted as one piece across the fabric width through the aligned helix loops of each helix strip A by any suitable means. The fabric may then again be heat treated to heat set the filler strips at a temperature of approximately 400 degrees F. Deformation of the closure element is not desired since retention of the shape and contour of the element are essential.

After the fabric construction is complete, according to the structure and method herein, the fabric is trimmed to the ordered width and a hot knife is passed along the edges to seal the edges joining the filler strand and helix strips as integral fabric structure. In addition, a width of cement may be applied to the fabric edges for increased stability.

Thus, it can be seen that a highly advantageous dryer fabric and method may be had for a non-woven dryer fabric wherein the permeability characteristics of the basic fabric may be lowered without heat treating in the low range of dryer fabric permeability of about 100 to 150 cfm.

While a preferred embodiment of the invention has been described using specific terms, such description is for illustrative purposes only, and it is to be understood that changes and variations may be made without departing from the spirit or scope of the following claims.

What is claimed is:

1. Apparatus for drying a web of paper material in a dryer section of a papermaking machine which includes a plurality of heated cylinders over which the web travels for drying, an endless traveling dryer belt carried about rollers and adjacent said cylinders contacting said web to hold said web against said heated cylinders for drying, said belt being of the type which comprises a non-woven fabric which includes a plurality of elongated helix means extending in a crosswise direction constructed from a polymeric material said helix means including helix loops having upper and lower runs presenting a web contacting surface for contacting said paper and curved bend portions joining said upper and lower runs, joint means received through adjoining intermeshing bend portions of adjacent helix means successively joining said helix means together in a machine direction to provide an endless dryer belt of desired dimension; an open loop space defined by said top and bottom runs of a said helix means and the intermeshing bend portions of adjoining helix means, said open loops being generally aligned cross-wise in said fabric; upper and lower pairs of corner crevice spaces created in said open loop space by said intermeshing bend portions of adjacent adjoining helix means extending therein; contoured monofilament filler means disposed between said runs in each said helix means across the width of said fabric in said cross-wise direction filling said open loop space, said monofilament filler means including a contoured portion extending laterally over said intermeshing bend portions of adjacent helix means and into at least one of said pairs of upper or lower crevice spaces to close said fabric mesh.

2. The apparatus of claim 1 wherein said contoured filler means includes a contoured monofilament filler element having a first base surface and a second surface spaced from said first surface which is widened relative to said first surface, said contoured filler element including crevice penetrating contoured edge means adjacent said widened surface for penetrating and occupying said crevice spaces.

3. The apparatus of claim 2 wherein said contoured edge means includes sides tapering outwardly from said first surface to said second surface; said tapering sides terminating in contoured feather edges at said widened surface which fit in and substantially fill said crevice spaces.

4. Tha apparatus of claim 1 wherein said contoured filler element occupies the crevice spaces of the corners of said loop spaces on the paper side of said fabric.

5. A non-woven permeable fabric comprising a plurality of elongated helix means extending cross-wise in said fabric and adjacent helix means intermeshed and adjoining one another lengthwise in said fabric, each said helix means including a plurality of open helix loops generally aligned across said fabric each said loop comprising a top run, a bottom run, and a bend portion joining said top and bottom runs, an open loop space defined by said top and bottom runs and the intermeshing bend portions of adjacent adjoining helix means, crevice spaces defined in the corners of said loop space between said runs and said intermeshing bend portions of said adjacent helix means, elongated contoured filler means within said open loop spaces extending crosswise in said fabric, said contoured monofilament filler means including contoured edge means extending laterally over said intermeshing bend portions of adjacent helix means for penetrating and occupying a number of said corner crevice spaces and reducing the permeability of said fabric.

6. The fabric of claim 5 wherein said contoured filler means includes a base surface, an enlarged surface widened relative to said base surface, and tapered sides tapering outwardly from said base surface to said enlarged surface forming said contoured edge means adjacent said enlarged radiating surface.

7. The fabric of claim 5 wherein said contoured edge means occupies the opposing corner crevice spaces adjacent said top run.

8. A permeable fabric for contacting and drying a paper web in a papermaking machine including a plurality of helix strip means with adjacent helix strip means intermeshing with one another, each said helix strip means including aligned open loops extending across said fabric, bend portions of adjacent intermeshing helix strip means extending into said open loop spaces creating crevice spaces in corners of said open loop spaces and contoured monofilament filler means extending within said loop spaces across said fabric, said contoured monofilament fiber means extending laterally over said intermeshing bend portions for penetrating and occupying a number of said crevice spaces for closing off fluid flow through said fabric.

9. The fabric of claim 8 wherein said contoured filler means includes a main contoured body portion occupying said open loop spaces and contoured edge means adjacent at least one surface of said main body portion substantially penetrating and occupying said crevice spaces and for providing an enlarged heat radiating surface facilitating drying of said paper.

10. A method for constructing a permeable belt fabric having a low permeability characteristic which includes joining a plurality of open helix strips to one another by intermeshing bend portions of the loops of adjacent ones of said helix strips, joining said intermeshing bend portions together, and filling the open loops with a contoured monofilament filler strip element having contoured edge portions which penetrates and occupies, at least in part, a number of corner crevice spaces formed by the intermeshing bend portions extending into said open loops of said helix strips to close off flow through the fabric and lower the permeability of said fabric.

* * * * *